US007985532B2

(12) United States Patent
Horiuchi

(10) Patent No.: US 7,985,532 B2
(45) Date of Patent: Jul. 26, 2011

(54) LIQUID DISCHARGE HEAD PRODUCING METHOD

(75) Inventor: Isamu Horiuchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 684 days.

(21) Appl. No.: 12/088,788

(22) PCT Filed: Nov. 6, 2006

(86) PCT No.: PCT/JP2006/322509
§ 371 (c)(1),
(2), (4) Date: Mar. 31, 2008

(87) PCT Pub. No.: WO2007/063690
PCT Pub. Date: Jun. 7, 2007

(65) Prior Publication Data

US 2009/0291398 A1 Nov. 26, 2009

(30) Foreign Application Priority Data

Dec. 2, 2005 (JP) ..... 2005-349487

(51) Int. Cl.
*B41J 2/16* (2006.01)

(52) U.S. Cl. ..... 430/320

(58) Field of Classification Search ..... None
See application file for complete search history.

(56) References Cited

U.S. PATENT DOCUMENTS

| | | | | |
|---|---|---|---|---|
| 5,478,606 | A | 12/1995 | Ohkuma et al. | |
| 6,162,589 | A * | 12/2000 | Chen et al. | 430/320 |
| 6,960,424 | B2 | 11/2005 | Miyagawa et al. | |
| 6,986,980 | B2 | 1/2006 | Kubota et al. | |
| 7,682,779 | B2 * | 3/2010 | Ishizuka | 430/320 |
| 2005/0181309 | A1 | 8/2005 | Miyagawa et al. | |
| 2007/0252872 | A1 | 11/2007 | Fujii et al. | |
| 2008/0309733 | A1 | 12/2008 | Horiuchi et al. | |

FOREIGN PATENT DOCUMENTS

| | | |
|---|---|---|
| EP | 1 275 508 | 1/2003 |
| JP | 2000-318167 | 11/2000 |
| JP | 2003-25595 | 1/2003 |

OTHER PUBLICATIONS

International Preliminary Report on Patentability in PCT Application No. PCT/JP2006/322509 dated Apr. 22, 2008.

* cited by examiner

*Primary Examiner* — John A. McPherson
(74) *Attorney, Agent, or Firm* — Fitzpatrick, Cella, Harper & Scinto

(57) ABSTRACT

Three positive-type photosensitive material layers which are photosensitive to light having the same wavelength range are provided on a substrate, and an intermediate layer contains a light-absorbing agent. The ultraviolet absorbing agent contained in the intermediate layer prevents the intermediate layer and lower layer from being exposed during the exposure of an upper layer. After the upper layer is exposed, the intermediate layer and lower layer are exposed with the light having the same wavelength range, which is used to expose the upper layer.

9 Claims, 3 Drawing Sheets

LIQUID DISCHARGE HEAD PRODUCING METHOD

TECHNICAL FIELD

The present invention relates to a method of producing a liquid discharge head which discharges a liquid, and specifically to a method of efficiently producing a micro flow path of an ink jet recording head used in an ink jet recording method.

BACKGROUND ART

An ink jet recording method which discharges ink on a recording medium to perform recording can be cited as an example in which a liquid discharge head for discharging a liquid is used.

The ink jet recording head to which the ink jet recording method is adopted usually includes an ink discharge port, an ink flow path, and an energy generating element. The energy generating element is provided in a part of the flow path, and generates energy for discharging the ink. Conventionally, for example, there is known a following method as the method of producing the ink flow path of the recording head.

In the producing method disclosed in U.S. Pat. No. 5,478,606, a pattern which becomes a mold of the ink flow path is formed with a soluble resin on a substrate in which the energy generating elements are formed, and a coating resin layer which becomes an ink flow path wall is formed on the mold pattern of the ink flow path. Then, orifices are formed on the energy generating element by photolithography, and the mold pattern of the ink flow path is eluted to cure the coating resin layer which becomes the ink flow path wall.

Recently, as high speed and high image quality are demanded in the ink jet printer, the flow path becomes miniaturized in the ink jet recording head.

For the method of forming the ink flow path with the pattern which becomes the mold, for example, as described in U.S. Pat. No. 6,986,980, a three-dimensional shape is optimized in the miniaturized ink flow path to achieve the speedup of ink refill.

In the method disclosed in U.S. Pat. No. 6,986,980, a first positive-type photosensitive material layer which is photosensitive to light having a first wavelength range while cross-linked is provided on the substrate in which the energy generating elements are formed, and the first positive-type photosensitive material layer is heated to form the cross-linked positive-type photosensitive material layer (lower layer). Then, a double-layer structure is formed by providing an upper layer including a second positive-type photosensitive material on the lower layer. The second positive-type photosensitive material is photosensitive to light having a second wavelength range which is different from the first wavelength range. Then, a predetermined portion of the upper layer of the double-layer structure is irradiated with the light having the second wavelength range. Subsequently, the irradiated region of the upper layer is removed to obtain a desired pattern by performing a development process. Then, a predetermined region of the lower layer which is exposed by the pattern formation of the upper layer is irradiated with the light having the first wavelength range, and the desired pattern is formed in the lower layer by performing the development process. Thus, the pattern which becomes the mold of the flow path is produced through the above steps.

However, in the ink jet recording head producing method described in U.S. Pat. No. 6,986,980, it is necessary to use two kinds of exposure wavelengths. Therefore, there is a problem that a process load is increased by complicating the process.

DISCLOSURE OF THE INVENTION

In view of the foregoing, an object of the invention is to provide a method in which an ink jet recording head, in which the shape of a three-dimensional flow path is optimized and discharge efficiency is improved, is efficiently produced with a simplified process. The invention has the following configuration.

A method of producing a liquid discharge head in which a discharge port for discharging a liquid and a liquid flow path communicated with the discharge port are provided, the liquid discharge head producing method including the steps of forming a first positive-type photosensitive material layer on a substrate; forming a second positive-type photosensitive material layer on the first positive-type photosensitive material layer, the second positive-type photosensitive material layer containing a light-absorbing agent absorbing light having a wavelength to which the first positive-type photosensitive material layer is photosensitive, the second positive-type photosensitive material layer being photosensitive to the light having the wavelength; forming a third positive-type photosensitive material layer on the second positive-type photosensitive material layer, the third positive-type photosensitive material layer being photosensitive to the light having the wavelength; exposing the third positive-type photosensitive material layer with the light having the wavelength; developing the third positive-type photosensitive material layer; exposing second photosensitive material layer and the first positive-type photosensitive material layer with the light having the wavelength; developing the second photosensitive material layer and the first photosensitive material layer; forming a coating layer on the substrate so as to coat the first photosensitive material layer, the second photosensitive material layer, and the third photosensitive material layer, to which the development has been performed; forming the discharge port in the coating layer; and forming the flow path by removing the first photosensitive material layer, the second photosensitive material layer, and the third photosensitive material layer.

According to the invention, the plural positive-type photosensitive materials are laminated, and are exposed and developed with the light having the one kind of wavelength when a mold pattern of a more complicated liquid flow path is formed. Therefore, the process can be simplified to decrease the production load.

Further features of the present invention will become apparent from the following description of exemplary embodiments with reference to the attached drawings.

BEST MODE FOR CARRYING OUT THE INVENTION

Figure 1:
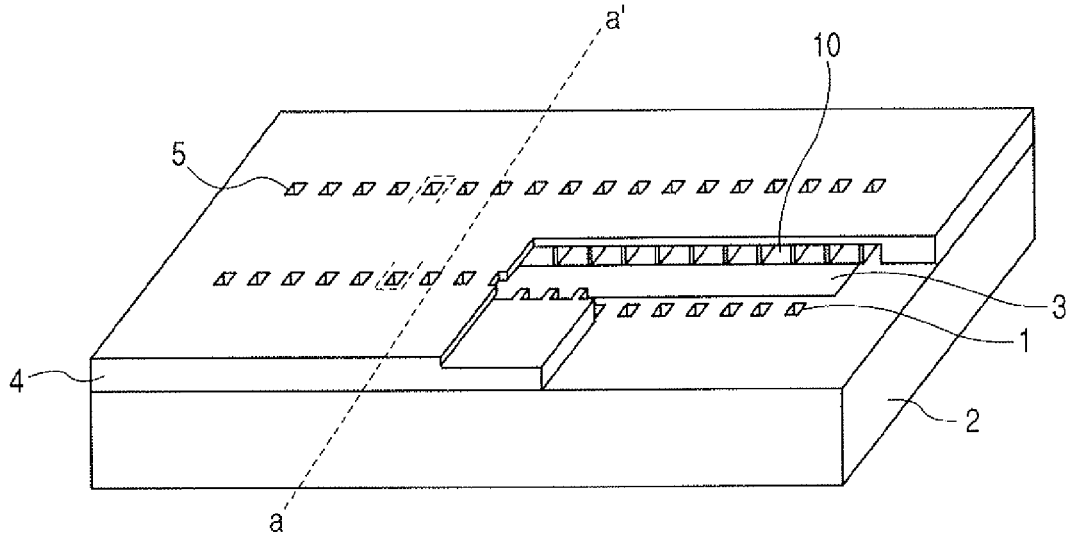
FIG. 1 is a perspective view showing a configuration of an ink jet recording head of the invention.

Preferred embodiments of the invention will be described below with reference to the accompanying drawings. In the following description, each element having the same function is designated by the same reference numeral in the drawings, and sometimes the description will be omitted.

In the following description, the ink jet recording method is cited as an application example of the invention. However, the application range of the invention is not limited to the ink jet recording method.

First, an ink jet recording head to which the invention can be applied and an ink jet cartridge on which the ink jet recording head is mounted will be described.

FIG. 1 is a schematic view showing an ink jet recording head according to an embodiment of the invention.

The ink jet recording head of the embodiment has a substrate 2. In the substrate 2, energy generating elements 1 which generate liquid discharge energy are arranged at predetermined pitches in two lines. Although Si is used as a material for forming the substrate 2 in the description, the invention is not limited to the Si substrate. An ink supply opening 3, which is formed by anisotropic etching of Si, is opened between the two lines of the energy generating elements 1. Discharge ports 5 and ink flow paths 10 are formed on a Si substrate 2 by an ink flow path wall forming member 4. The discharge port 5 is opened above each of the energy generating elements 1, and the ink flow path 10 is individually communicated with each discharge port 5 from the ink supply opening 3.

The ink jet recording head is arranged such that a surface having the ink supply opening 3 formed therein faces a recording surface of the recording medium. When a pressure generated from the energy generating element 1 is applied to the ink with which the ink flow path 10 is filled through the ink supply opening 3, an ink droplet is discharged from the ink discharge port 5 to adhere to the recording medium, and thereby the recording is performed.

The ink jet recording head can be mounted on an apparatus such as a printer, a copying machine, a facsimile machine, and a word processor with a printer unit and an industrial recording apparatus which is combined with various processing apparatuses.

Then, a process of producing a liquid flow path by an ink jet recording head producing method of the invention will be described with reference to FIGS. 2A, 2B, 2C, 2D, 2E, 2F, 2G, 2H, 2I and 2J. Each drawing of FIGS. 2A, 2B, 2C, 2D, 2E, 2F, 2G, 2H, 2I and 2J is a sectional view taken along line a'-a of FIG. 1 in the production process.

Figure 2A:
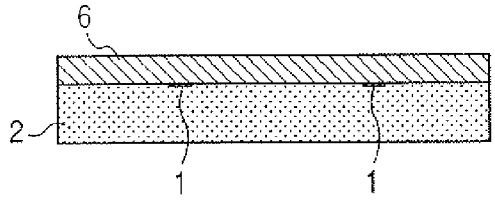
FIGS. 2A, 2B, 2C, 2D, 2E, 2F, 2G, 2H, 2I and 2J are sectional views schematically showing an ink jet recording head producing method of the invention.

As shown in FIG. 2A, a first positive-type photosensitive material layer 6 is formed by laminating a first positive-type photosensitive material on the substrate including the energy generating elements 1. Glass, ceramics, plastic, metal, and the like can be used as the substrate in addition to Si. Generally various functional layers such as a protective layer are provided in order to lengthen a service life of the energy generating elements. Obviously, the functional layers may be also provided in the invention.

Figure 2B:
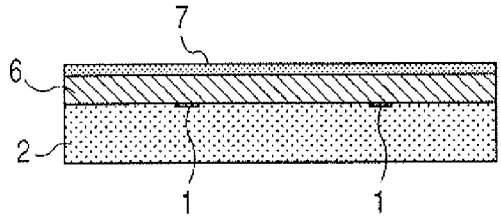

Then, as shown in FIG. 2B, a second positive-type photosensitive material layer 7 is formed on the first positive-type photosensitive material layer 6 by laminating a second positive-type photosensitive material containing an ultraviolet absorbing agent. Any material can be used as the second positive-type photosensitive material with no particular limitation as long as the material has a photosensitive wavelength in the same wavelength range as that of the first positive-type photosensitive material. Any light-absorbing agent can be used with no particular limitation as long as the light-absorbing agent exhibits absorption in the photosensitive wavelength ranges in the first and second positive-type photosensitive materials. The light-absorbing agent known as an ultraviolet absorbing agent can mainly be used. Although the ultraviolet absorbing agent is used in the following description, the invention is not limited to the ultraviolet absorbing agent. The following materials can be cited as an example of the ultraviolet absorbing agent.

2-hydroxy-4-methoxybenzophenone, 2-hydroxy-4-n-octoxybenzophenone, 2-hydroxy-4-n-dodecyloxybenzophenone, 2-hydroxy-4-benzyloxybenzophenone, 2,2'-hydroxy-4-methoxybenzophenone, phenyl salicylate, 4-t-butyl phenyl salicylate, 2-hydroxy-4-methoxybenzophenone, and 2,4-di-t-butyl phenyl-3',5'-di-t-butyl-4-hydroxybenzoate At this point, particularly desirably the second positive-type photosensitive material layer is formed while a thickness is not more than 2 μm, and the light-absorbing agent is not lower than 3 wt % to the photosensitive material layer. In the subsequent step, the second photosensitive material layer acts as a light shielding layer for the first photosensitive material layer of the lower layer during exposure of the third photosensitive material layer of the upper layer. In this case, the second photosensitive material layer of itself might be exposed. However, in consideration of an exposure amount of a multipurpose apparatus ranging from about 5 to about 20 J, a decrease in thickness (so-called film thickness decrease) of the second photosensitive material layer can be suppressed to 1 μm or less when the thickness of the second positive-type photosensitive material layer and the addition amount of light-absorbing agent are satisfied. The slight decrease in thickness to this extent can be sufficiently permitted in the liquid discharge head. However, the addition amount of light-absorbing agent can be preferably selected according to absorption characteristics of the added light-absorbing agent, and the invention is not limited to the addition amount not lower than 3 wt %.

Figure 2C:
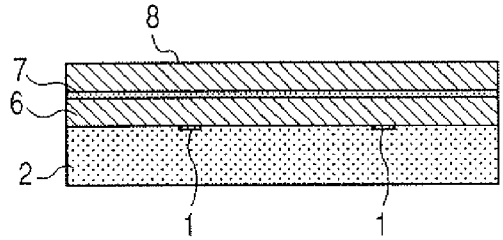

Then, as shown in FIG. 2C, a third positive-type photosensitive material layer 8 is formed by laminating a third positive-type photosensitive material on the photosensitive material layers already formed on the substrate. Any material can be used as the third positive-type photosensitive material with no particular limitation as long as the material has the same photosensitive wavelength range as the first and second positive-type photosensitive materials. From the viewpoint of selectivity of a solvent used in forming each photosensitive material layer, it is particularly preferable that the first to third photosensitive materials be made of the same composition. A general positive-type photosensitive resin can be used as the first, second, and third photosensitive materials. For example, polymethyl isopropenyl ketone, polymethyl methacrylate, and polyvinyl ketone can be used as the first, second, and third photosensitive materials. Particularly a photodecomposition-type positive type resist having relatively high molecular weight is used such that mold breakage is not generated in laminating a coating resin in the subsequent process.

A method, in which the photosensitive material is dissolved in the solvent and applied by a spin coating method or a roller coating method, can be cited as the method of laminating the photosensitive material.

Figure 2D:
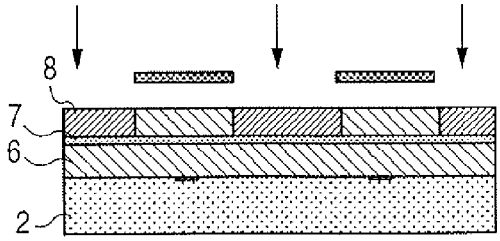

Then, as shown in FIG. 2D, a part of the third positive-type photosensitive material layer 8 is exposed using a mask. The irradiating light is attenuated by the absorption of the third positive-type photosensitive material layer 8. The exposure to the first and second positive-type photosensitive material layers can be suppressed as much as possible because the ultraviolet absorbing agent in the second positive-type photosensitive material layer 7 fulfills the function of blocking the irradiating light to the first positive-type photosensitive material layer 6 of the lower layer. For this reason, the exposure of the third positive-type photosensitive material layer has no influence on the first positive-type photosensitive material layer. Although the slight exposure is possibly generated in the second positive-type photosensitive material layer, the exposure of the second positive-type photosensitive material layer is suppressed to a negligible influence because the thickness of the second positive-type photosensitive material layer is sufficiently thin compared with the first positive-type photosensitive material layer.

Figure 2E:
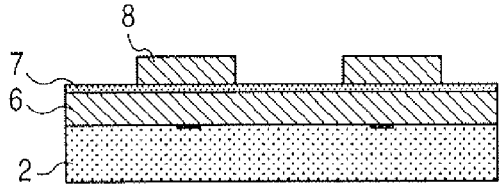

Then, as shown in FIG. 2E, the desired liquid flow path pattern is formed in the third positive-type photosensitive material layer 8 by the development. Alternatively, the process may be transferred to the later-mentioned step of exposing the lower layer while the development is not performed to remain the exposed portion. In this case, the second and first positive-type photosensitive material layers are exposed through the third positive-type photosensitive material layer 8.

Figure 2F:
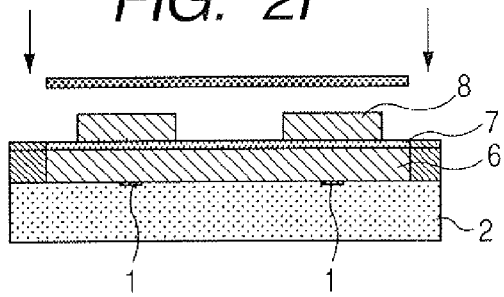

Then, as shown in FIG. 2F, the second and first positive-type photosensitive material layers are exposed by the same wavelength used in exposing the third positive-type photosensitive material layer 8 with the mask. Usually the exposure amount is larger than that of the third positive-type photosensitive material layer because the first photosensitive material layer is irradiated with the light through the second photosensitive material layer 7 containing the ultraviolet absorbing agent. Specifically, the exposure amount of each of the first and second positive-type photosensitive material layers is desirably about triple the exposure amount of the third positive-type photosensitive material layer.

Figure 2G:
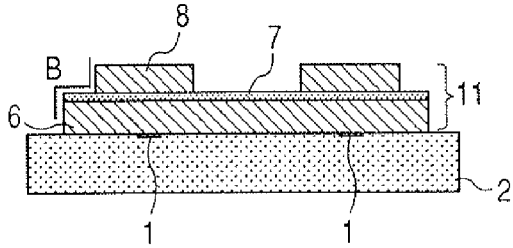

Then, as shown in FIG. 2G, a desired pattern is also formed in the first and second photosensitive resin layers by the development. Thus, a pattern 11 is completed on the substrate. The pattern 11 becomes a mold of a flow path 10 having a partial step (B in FIG. 2G).

Figure 2H:
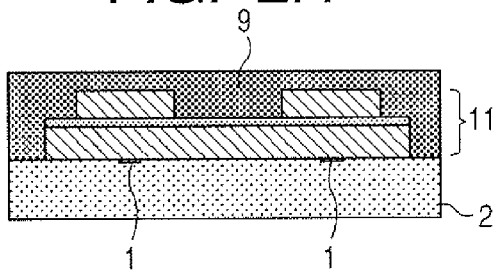

Then, as shown in FIG. 2H, a coating resin layer 9 is formed on the pattern 11. Examples of the material forming the coating resin layer 9 include epoxy resin and polyimide resin.

Figure 2I:
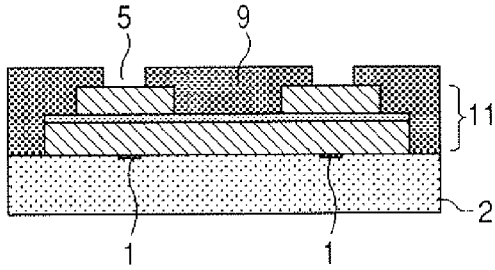

Then, as shown in FIG. 2I, a discharge port is formed by the photolithography.

Figure 2J:
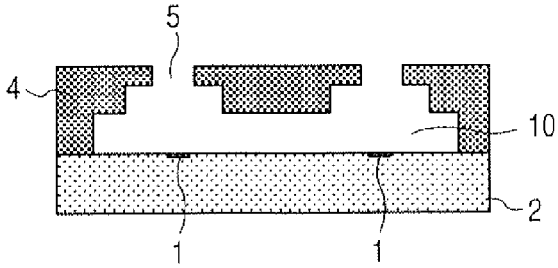

Then, as shown in FIG. 2J, the soluble resin by which the pattern 11 is formed is eluted to form a flow path.

Thus, the liquid flow path 10 is completed through the above steps.

The invention can be also applied to a more precise flow path structure, for example, a flow path structure having many points at which a sectional area is locally changed in a direction from the substrate toward the discharge port. In this case, after the step shown in FIG. 2C, a positive-type photosensitive material layer containing an ultraviolet absorbing agent is further provided, a positive-type photosensitive material layer is further provided thereon, and then the subsequent steps may be performed.

EXAMPLE

Subsequently, an Example of the invention will be described with reference to FIGS. 3A, 3B, 3C, 3D, 3E, 3F, 3G, 3H and 3I.

Figure 3A:
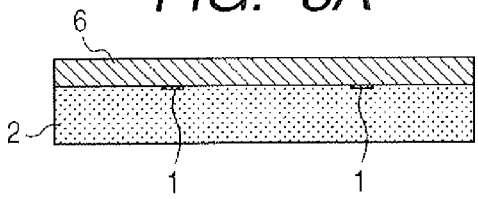
FIGS. 3A, 3B, 3C, 3D, 3E, 3F, 3G, 3H and 3I are sectional views schematically showing an ink jet recording head producing method of the invention.

A film of a first positive-type photosensitive material made of polymethyl isopropenyl ketone is formed on the substrate 2 including the energy generating elements 1 by the spin coating method, and a first positive-type photosensitive material layer 6 having a thickness of 10 μm is formed by baking at 120° C. for six minutes (FIG. 3A).

Figure 3B:
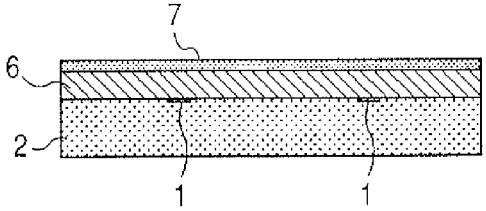

Then, a film of a second positive-type photosensitive material is formed by the spin coating method, and a second positive-type photosensitive material layer 7 having a thickness of 2 μm is formed by baking at 120° C. for six minutes (FIG. 3B). The second positive-type photosensitive material mainly contains polymethyl isopropenyl ketone, and contains 9 wt % 2-hydroxy-4-methoxybenzophenone in the total weight as the ultraviolet absorbing agent.

Figure 3C:
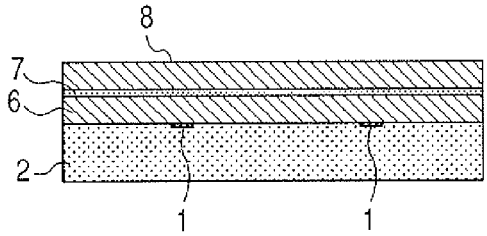

Then, a film made of polymethyl isopropenyl ketone is formed by the spin coating method, and a third positive-type photosensitive material layer 8 is formed by baking at 120° C. for six minutes (FIG. 3C).

Figure 3D:
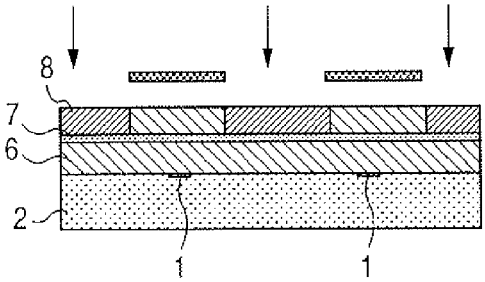

Then, a part of the third positive-type photosensitive material layer 8 is exposed with the light having the wavelength of 290 nm on the condition of 5300 mJ/cm2 using UX3000 (product name of USHIO INC.) (FIG. 3D).

Figure 3E:
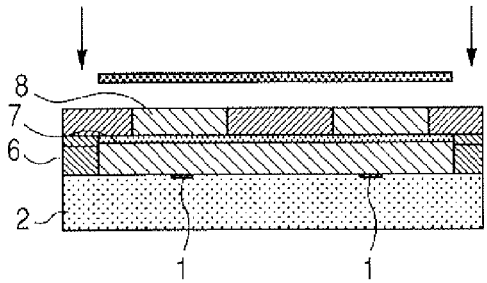

The second and first positive-type photosensitive material layers are exposed through the exposed portion of the third positive-type photosensitive material layer 8 with the light having the wavelength of 290 nm on the condition of 15000 mJ/cm2 using UX3000 (product of USHIO INC.) (FIG. 3E).

Figure 3F:
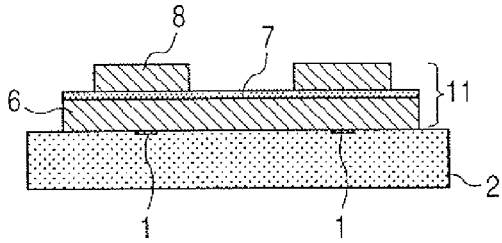

Then, the development is performed with methyl isobutyl ketone to form a pattern 11 to become a mold of the flow path (FIG. 3F).

Figure 3G:
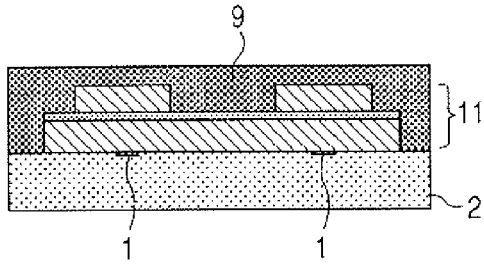
Figure 3H:
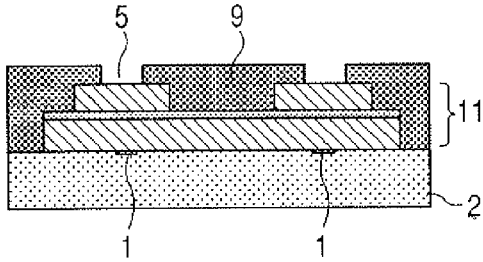
Figure 3I:
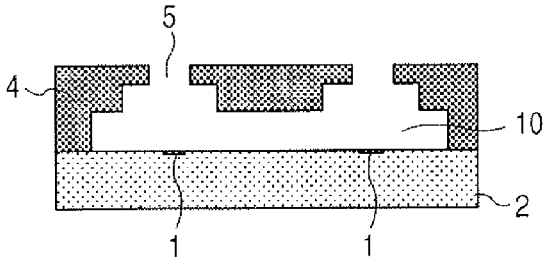

Then, a material obtained by dissolving the resin composition described in Table 1 in xylene is applied onto the substrate 2 by a solvent coating method, and pre-baking is performed at 90° C. for four minutes to form a coating resin layer 9 (FIG. 3G). Subsequently, the exposure is performed with the liquid discharge port mask pattern using a mask aligner MPA-600 Super (product of Canon Inc.), and the development is performed to form a discharge port 5 (FIG. 3H).

TABLE 1

| Epoxy resin | Cation polymerization initiator | Additive |
|---|---|---|
| EHPE3150<br>DAISEL CHEMICAL INDUSTRIES, LTD.<br>100 parts | SP-172<br>ADEKA CORPORATION<br>2 parts | A-187<br>Nippon Unicar Company Limited<br>5 parts |

Finally, the supply opening 3 (not shown) for supplying the ink is formed, and electric connection (not shown) for driving the energy generating elements 1 is performed to complete the ink jet recording head.

The good image recording could be performed when the ink jet recording head produced by the producing method of Example was mounted on the recording apparatus to evaluate the discharge and recording.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2005-349487 filed Dec. 2, 2005, which is hereby incorporated by reference herein.

The invention claimed is:

1. A method of producing a liquid discharge head in which a discharge port for discharging a liquid and a liquid flow path communicated with the discharge port are provided, the method comprising the steps of:

forming a first positive-type photosensitive material layer on a substrate;

forming a second positive-type photosensitive material layer on the first positive-type photosensitive material layer, the second positive-type photosensitive material layer containing a light-absorbing agent absorbing light having a wavelength to which the first positive-type photosensitive material layer is photosensitive, the second positive-type photosensitive material layer being photosensitive to the light having the wavelength;

forming a third positive-type photosensitive material layer on the second positive-type photosensitive material layer, the third positive-type photosensitive material layer being photosensitive to the light having the wavelength;

exposing the third positive-type photosensitive material layer with the light having the wavelength;

developing the third positive-type photosensitive material layer;

exposing the second photosensitive material layer and the first positive-type photosensitive material layer with the light having the wavelength;

developing the second photosensitive material layer and the first photosensitive material layer;

forming a coating layer on the substrate so as to coat the first photosensitive material layer, the second photosensitive material layer, and the third photosensitive material layer, to which the development has been performed;

forming the discharge port in the coating layer; and forming the flow path by removing the first photosensitive material layer, the second photosensitive material layer, and the third photosensitive material layer.

2. A liquid discharge head producing method according to claim 1, wherein intensity of the light having the wavelength with which the second photosensitive material layer and the first photosensitive material layer are exposed is stronger than intensity of the light having the wavelength in the step of exposing the third positive-type photosensitive material layer.

3. A liquid discharge head producing method according to claim 2, wherein the intensity of the light having the wavelength with which the second photosensitive material layer and the first photosensitive material layer are exposed is not lower than triple the intensity of the light having the wavelength in the step of exposing the third positive-type photosensitive material layer.

4. A liquid discharge head producing method according to claim 1, wherein the step of developing the third photosensitive material layer and the step of developing the second photosensitive material layer and the first photosensitive material layer are concurrently performed after the step of exposing the third photosensitive material layer with the light having the wavelength and the step of exposing the first photosensitive material layer and the second photosensitive material layer with the light having the wavelength.

5. A liquid discharge head producing method according to claim 1, wherein the first to third positive-type photosensitive materials are made of the same composition.

6. A liquid discharge head producing method according to claim 5, wherein the composition is polymethyl isopropenyl ketone.

7. A liquid discharge head producing method according to claim 1, wherein the step of forming the coating layer is performed by application.

8. A liquid discharge head producing method according to claim 1, wherein a thickness of the second photosensitive material layer is not more than 2 μm, and a loading amount of light-absorbing agent is not lower than 3 percent by weight to the photosensitive material layer.

9. A method of producing a liquid discharge head in which a discharge port for discharging a liquid and a liquid flow path communicated with the discharge port are provided, the method comprising the steps of:

preparing a laminated material constituted by a first positive-type photosensitive material layer, a second positive-type photosensitive material layer, and a third positive-type photosensitive material layer, on a substrate, the first positive-type photosensitive material layer among the plural material layers being closest to the substrate, the second positive-type photosensitive material layer being positioned between the first positive-type photosensitive material layer and the third positive-type photosensitive material layer, the second positive-type photosensitive material layer containing a light-absorbing agent absorbing light having a wavelength to which the first positive-type photosensitive material layer is photosensitive, the second positive-type photosensitive material layer being photosensitive to the light having the wavelength, the third positive-type photosensitive material layer being photosensitive to the light having the wavelength;

exposing the third positive-type photosensitive material layer with the light having the wavelength;

developing the third positive-type photosensitive material layer;

exposing the second positive-type photosensitive material layer and the first positive type photosensitive material layer with the light having the wavelength;

developing the second photosensitive material layer and the first photosensitive material layer;

forming a coating layer on the substrate so as to coat the first photosensitive material layer, the second photosensitive material layer, and the third photosensitive material layer, to which the development has been performed;

forming the discharge port in the coating layer; and forming the flow path by removing the first photosensitive material layer, the second photosensitive material layer, and the third photosensitive material layer.

* * * * *